US005884252A

United States Patent [19]

Ozawa

[11] Patent Number: 5,884,252

[45] Date of Patent: Mar. 16, 1999

[54] METHOD OF AND APPARATUS FOR CODING SPEECH SIGNAL

[75] Inventor: Kazunori Ozawa, Tokyo, Japan

[73] Assignee: NEC Corporation, Tokyo, Japan

[21] Appl. No.: 657,660

[22] Filed: May 31, 1996

[30] Foreign Application Priority Data

May 31, 1995 [JP] Japan ..... 7-133372

[51] Int. Cl.[6] ..... G10L 3/02

[52] U.S. Cl. ..... 704/220; 704/229; 704/230

[58] Field of Search ..... 704/219, 220, 704/221, 222, 226, 229, 230

[56] References Cited

U.S. PATENT DOCUMENTS

| | | | |
|---|---|---|---|
| 4,985,923 | 1/1991 | Ichikawa et al. | 381/38 |
| 5,077,798 | 12/1991 | Ichikawa et al. | 381/36 |
| 5,091,945 | 2/1992 | Kleijn | 395/2.28 |
| 5,208,862 | 5/1993 | Ozawa | 395/2.25 |
| 5,230,036 | 7/1993 | Akamine et al. | 395/2 |
| 5,396,576 | 3/1995 | Miki et al. | 395/2.31 |
| 5,426,718 | 6/1995 | Funaki et al. | 395/2.25 |
| 5,485,581 | 1/1996 | Miyano et al. | 395/2.32 |
| 5,487,128 | 1/1996 | Ozawa | 395/2.31 |
| 5,546,498 | 8/1996 | Sereno | 395/2.38 |
| 5,598,504 | 1/1997 | Miyano | 395/2.31 |
| 5,625,744 | 4/1997 | Ozawa | 395/2.31 |
| 5,633,980 | 5/1997 | Ozawa | 395/2.31 |

FOREIGN PATENT DOCUMENTS

| | | |
|---|---|---|
| 0 607 989 | 7/1994 | European Pat. Off. . |
| 2 709 367 | 8/1993 | France . |
| 63-033025 | 2/1988 | Japan . |
| 64-72200 | 3/1989 | Japan . |
| 4-171500 | 6/1992 | Japan . |
| 4-305135 | 10/1992 | Japan . |
| 4-363000 | 12/1992 | Japan . |
| 5-6199 | 1/1993 | Japan . |
| 5-265496 | 10/1993 | Japan . |
| 6-222797 | 8/1994 | Japan . |
| 7-64600 | 3/1995 | Japan . |

OTHER PUBLICATIONS

Schroeder et al., "Code–Excited Linear Prediction (CLEP): High–Quality Speech At Very Low Bit Rates", Proc. ICASSP, (1985), pp. 937–940.

Kleijn et al., "Improved Speech Quality and Efficient Vector Quantization In SELP", Proc. ICASSP, (1988), pp. 155–158.

Singhal et al., "Optimizing LPC Filter Parameters for Multi–Pluse Excitation", Proc. ICASSP, (1983), pp. 781–784.

Nakamizo, "Signal Analysis and System Indentification", Corona Co. Ltd., (1988), 82–87.

Sugamura et al., "Speech Data Compression by LSP Speech Analysis–Synthesis Technique", Journal of Electronic Communication Society, (1981) pp. 599–606.

Nomura et al., "LSP Coding Using VQ–SVQ With Interpolation In 4.075 KBP M–LCELP Speech Coder", Proc. Mobile Multimedia Communications, (1993), pp. B.2.1–B.2.4.

Taniguchi et al., "Improved CELP Speech Coding at 4 KBIT/S and Below", Proc. ICSLP, (1992), 41–44.

(List continued on next page.)

*Primary Examiner*—David R. Hudspeth
*Assistant Examiner*—Michael N. Opsasnick
*Attorney, Agent, or Firm*—Foley & Lardner

[57] ABSTRACT

In a speech coding apparatus, a spectral parameter calculator determines spectral parameters from an inputted speech signal, quantizes the spectral parameters, and outputs a plurality of quantization candidates. An adaptive code book determines delays with respect to each of the quantization candidates outputted from the spectral parameter calculator, generates a pitch predictive signal based on a past excitation signal for each of the delays and associating quantization candidates, and outputs a quantization candidate and a delay that provide a minimum distortion between the speech signal and the pitch predictive signal. An excitation quantizer quantizes and outputs the excitation signal of the speech signal. A gain quantizer quantizes and outputs a gain of at least one of the adaptive code book and the quantized excitation signal.

19 Claims, 11 Drawing Sheets

OTHER PUBLICATIONS

Kroon et al., "Pitch Predictors With High Temporal Resolution", Proc. ICASSP, (1990), pp. 661–664.

Chang et al., "A Low Data Rate LPC Vocoder Using Contour Quantization", vol. 1, 24–27 Aug. 1992 Brussels, BE, pp. 459–462.

METHOD OF AND APPARATUS FOR CODING SPEECH SIGNAL

BACKGROUND OF THE INVENTION

1. Field of the Invention

The present invention relates to a method of and an apparatus for coding a speech signal with high quality at a low bit rate.

2. Description of the Related Art

Various processes have been proposed for coding speech signals highly efficiently. For example, one such process is disclosed in M. Schroeder and B. Atal "Code—excited linear prediction: High quality speech at very low bit rates" (Proc. ICASSP, pp. 937–940, 1985, hereinafter referred to as "document 1"). Another process is CELP (Code Excited Linear Predictive Coding) described in Kleijn et al. "Improved speech quality and efficient vector quantization in CELP" (Proc. ICASSP, pp. 155–158, 1988, hereinafter referred to as "document 2").

According to the above conventional proposals, a transmitter extracts spectral parameters representing spectral characteristics of a speech signal from the speech signal in each frame of 20 ms, for example, using linear predictive coding (LPC). Each frame is divided into subframes each of 5 ms, for example, and parameters, i.e., a delay parameter and a gain parameter corresponding to a pitch period, in an adaptive code book are extracted in each subframe based on a past excitation signal, for pitch prediction of the speech signal in the subframes using the adaptive code book. For a excitation signal determined by pitch prediction, an optimum excitation code vector is selected from a excitation code book (vector quantization code book) of noise signals of predetermined type to calculate an optimum gain for thereby quantizing the excitation signal.

The excitation code vector is selected in a manner to minimize any error power between a signal synthesized from a selected noise signal and a residual signal. An index and a gain which indicate the type of the selected code vector, and the spectral parameters and the parameters in the adaptive code book are combined by a multiplexer and transmitted. Details of a receiver will not be described below.

The above conventional speech signal coding process employs linear predictive coding (LPC) for the calculation of spectral parameters. Female speakers with high pitches utter phonemes whose speech formants and pitch frequencies are close to each other. Since such phonemes are strongly affected by pitches, a large error is encountered in the extraction of spectral parameters from the phonemes. If a pitch is extracted using such wrong spectral parameters, then a wrong pitch period results. When a speech signal is coded using those spectral parameters and pitch, the quality of sound of the speech signal is poor for female speakers with high pitch frequencies, especially if the bit rate is low.

One proposed solution has been to determine spectral parameters with a multipulse signal, rather than a white noise signal, assumed as a excitation signal. For example, reference should be made to Singhal and Atal "Optimizing LPC filter parameters for multi-pass extraction" (Proc. ICASSP, pp. 781–784, 1983, hereinafter referred to as "document 3").

For speech signal coding, it is necessary to quantize spectral parameters and excitation signals for transmitting them. To lower the bit rate, the spectral parameters have to be subjected to rough quantization, and cannot be free from effects which the quantization has on the spectral parameters. According to the process revealed in the document 3, any effects which quantization has on spectral parameters and excitation signals are not taken into account, and the performance of speech signal coding is lowered by rough quantization, resulting in a reduction in the quality of sounds uttered by female speakers.

SUMMARY OF THE INVENTION

It is an object of the present invention to provide a method of and an apparatus for coding a speech signal while being less subject to effects of a pitch when a bit rate is low, and using spectral parameters taking quantization and delays in an adaptive code book into account.

According to a first aspect of the present invention, there is provided an apparatus for coding a speech signal, comprising:

a spectral parameter calculator for determining spectral parameters from an inputted speech signal, quantizing the spectral parameters, and outputting a plurality of quantization candidates;

an adaptive code book for determining delays with respect to each of said quantization candidates outputted from said spectral parameter calculator, generating a pitch predictive signal based on a past excitation signal for each of the delays and associating quantization candidates, and outputting a quantization candidate and a delay which provide a minimum distortion between the speech signal and said pitch predictive signal;

a excitation quantizer for quantizing and outputting the excitation signal of said speech signal ; and a gain quantizer for quantizing and outputting a gain of at least one of said adaptive code book and said excitation signal.

According to a second aspect of the present invention, there is provided an apparatus for coding a speech signal, comprising:

a spectral parameter calculator for determining spectral parameters from an inputted speech signal, quantizing the spectral parameters, and outputting a plurality of quantization candidates;

an adaptive code book for determining delay, generating delay candidates existing within predetermined delay range, generating a pitch predictive signal calculated using a signal extracted from past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said quantized excitation signal; and a gain quantizer for quantizing and outputting a gain of at least one of said adaptive code book and said quantized excitation signal.

According to a third aspect of the present invention, there is provided an apparatus for coding a speech signal, comprising:

a spectral parameter and delay calculator for calculating spectral parameters and a first delay from a signal extracted from a past excitation signal for a delay and an inputted speech signal;

a spectral parameter quantizer for quantizing the spectral parameters and outputting at least one quantization candidate;

an adaptive codebook for determining second delay based on said first delay, calculating at least one second delay candidate neighboring said first delay, generating a pitch predictive signal calculated using a signal scissored from past excitation signal for said second delay candidate and quantization candidate, for all of the combinations between each of second delay candidates and each of quantization candidates, a excitation quantizer for quantizing and outputting the excitation signal of said speech signal; and a gain quantizer for quantizing and outputting a gain of at least one of said adaptive code book and said quantized excitation signal.

According to a fourth aspect of the present invention, there is provided an apparatus for coding a speech signal, comprising:

a spectral parameter and delay calculator for being supplied with an inputted speech signal, jointly calculating spectral parameters and a first delay from a signal extracted from a past drive signal for a delay and the inputted speech signal;

a drive signal calculator for calculating a drive signal from said spectral parameters and said speech signal;

a spectral parameter quantizer for quantizing the spectral parameters and outputting at least one quantization candidate;

an adaptive codebook for determining second delay based on said first delay, calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates;

a excitation quantizer for quantizing and outputting the excitation signal of said speech signal; and a gain quantizer for quantizing and outputting a gain of at least one of said adaptive code book and said quantized excitation signal.

According to a fifth aspect of the present invention, there s provided an apparatus for coding a speech signal, comprising:

a mode decision unit for deciding a mode of an inputted speech signal and outputting mode decision information;

a spectral parameter calculator for determining spectral parameters from the speech signal, quantizing the spectral parameters, and outputting a plurality of quantization candidates;

an adaptive code book for determining delay with respect to each of said quantization candidates, respectively, outputted from said spectral parameter quantizer, generating a pitch predective signal based on a past excitation signal for each of the delays and associating quantization candidates, and outputting a quantization candidate and a delay which provide a minimum distortion between the speech signal and said pitch predictive signal, if the mode decision information outputted from said mode decision unit represents a predetermined mode;

a excitation quantizer for quantizing and outputting the excitation signal of said speech signal; and a gain quantizer for quantizing and outputting a gain of at least one of said adaptive code book and said quantized excitation signal.

According to a sixth aspect of the present invention, there is provided an apparatus for coding a speech signal, comprising:

a mode decision unit for deciding a mode of an inputted speech signal and outputting mode decision information;

a spectral parameter calculator for determining spectral parameters from the speech signal, quantizing the spectral parameters, and outputting a plurality of quantization candidates;

an adaptive codebook for determining delay, generating delay candidates existing within predetermined delay range, generating a pitch predictive signal calculated using a signal extracted from past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said pitch predictive signal, if the mode decision information outputted from said mode decision unit represents a predetermined mode; and a gain quantizer for quantizing and outputting a gain of at least one of said adaptive code book and said quantized excitation signal.

According to a seventh aspect of the present invention, there is provided an apparatus for coding a speech signal, comprising:

a mode decision unit for deciding a mode of an inputted speech signal and outputting mode decision information;

a spectral parameter calculator for determining spectral parameters from the speech signal, quantizing the spectral parameters, and outputting a plurality of quantization candidates;

a spectral parameter and delay calculator for calculating spectral parameters and a first delay from a signal scissored from a past excitation signal for a delay and an inputted speech signal;

a spectral parameter quantizer for quantizing the spectral parameters and outputting at least one quantization candidate;

an adaptive codebook for determing second delay based on said first delay, calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates, if the mode decision information outputted from said mode decision unit represents a predetermined mode; and a excitation quantizer for quantizing and outputting the excitation signal of said speech signal; and a gain quantizer for quantizing and outputting a gain of at least one of said adaptive code book and said quantized excitation signal.

According to an eighth aspect of the present invention, there is provided an apparatus for coding a speech signal, comprising:

a mode decision unit for deciding a mode of an inputted speech signal and outputting mode decision information;

a spectral parameter and delay calculator for being supplied with an inputted speech signal, jointly calculating spectral parameters and a first delay from a signal extracted from a past drive signal for a delay and the inputted speech signal;

a drive signal calculator for calculating a drive signal from said spectral parameters and said speech signal;

a spectral parameter quantizer for quantizing the spectral parameters and outputting at least one quantization candidate;

an adaptive codebook for determing second delay based on said first delay, calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates, if the mode decision information outputted from said mode decision unit represents a predetermined mode;

a excitation quantizer for quantizing and outputting the excitation signal of said speech signal; and a gain quantizer for quantizing and outputting a gain of at least one of said adaptive code book and said quantized excitation signal.

According to the first aspect of the present invention, there is provided a method of coding a speech signal, comprising the steps of:

determining spectral parameters from an inputted speech signal, quantizing the spectral parameters, and outputting a plurality of quantization candidates; and determining delays with respect to said quantization candidates, generating a pitch predictive signal based on a past excitation signal for each of the delays and each of the quantization candidates, and determining a quantization candidate and a delay which provide a minimum distortion between the inputted speech signal and said pitch predictive signal.

According to the second aspect of the present invention, there is provided a method of coding a speech signal, comprising the steps of:

determining spectral parameters from an inputted speech signal, quantizing the spectral parameters, and outputting a plurality of quantization candidates;

determining delay, generating delay candidates existing within predetermined delay range, generating a pitch predictive signal calculated using a signal scissored from past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said quantized excitation signal.

According to the third aspect of the present invention, there is provided a method of coding a speech signal, comprising the steps of:

calculating spectral parameters and a first delay from a signal extracted from a past excitation signal for a delay and an inputted speech signal;

determining at least one quantization candidate for said spectral parameters; and calculating at least one second delay based on said first delay, calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates.

According to the fourth aspect of the present invention, there is provided a method of coding a speech signal, comprising the steps of:

inputting a speech signal, calculating spectral parameters and a first delay from a signal extracted from a past drive signal for a delay and the inputted speech signal;

calculating a drive signal from said spectral parameters and said speech signal;

determining at least one quantization candidate for said spectral parameters;

calculating at least one second delay based on said first delay, calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates.

According to the fifth aspect of the present invention, there is provided a method of coding a speech signal, comprising the steps of:

deciding a mode of an inputted speech signal;

determining spectral parameters from the speech signal, quantizing the spectral parameters, and determining a plurality of quantization candidates; and determining delay with respect to each of said quantization candidates, respectively, outputted from said spectral parameter quantizer, generating a pitch predective signal based on a past excitation signal for each of the delays and associating quantization candidates, and outputting a quantization candidate and a delay which provide a minimum distortion between the speech signal and said pitch predictive signal, if the mode decision information outputted from said mode decision unit represents a predetermined mode.

According to the sixth aspect of the present invention, there is provided a method of coding a speech signal, comprising the steps of:

deciding a mode of an inputted speech signal;

determining spectral parameters from the speech signal, quantizing the spectral parameters, and determining a plurality of quantization candidates; and determining delay, generating delay candidates existing within predetermined delay range, generating a pitch predictive signal calculated using a signal extracted from past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said pitch predective signal, if the mode decision information outputted from said mode decision unit represents a predetermined mode.

According to the seventh aspect of the present invention, there is provided a method of coding a speech signal, comprising the steps of:

deciding a mode of an inputted speech signal;

determining spectral parameters from the speech signal, quantizing the spectral parameters, and determining a plurality of quantization candidates;

calculating spectral parameters and a first delay from a signal extracted from a past excitation signal for a delay and the inputted speech signal;

quantizing the spectral parameters and determining at least one quantization candidate; and calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates, if the mode decision information outputted from said mode decision unit represents a predetermined mode.

According to the eighth aspect of the present invention, there is provided a method of coding a speech signal, comprising the steps of:

deciding a mode of an inputted speech signal;

calculating spectral parameters and a first delay from a signal scissored from a past drive signal for a delay and the inputted speech signal;

calculating a drive signal from said spectral parameters and said speech signal;

quantizing said spectral parameters and determining at least one quantization candidate; and calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates, if the mode decision information outputted from said mode decision unit represents a predetermined mode.

In the apparatus and method according to the first aspect of the present invention, the adaptive code book calculates delays with respect to a plurality of quantization candidates (e.g., M quantization candidates) for spectral parameters, calculates a pitch predictive signal with respect to combinations of the M quantization candidates and the delays, calculates an error power with respect to an inputted speech signal, and outputs a combination of a quantization candidate and a delay which minimize the error power.

In the apparatus and method according to the second aspect of the present invention, the adaptive code book calculates a pitch predictive signal with respect to all combinations of a plurality of quantization candidates (e.g., M quantization candidates) for spectral parameters and a plurality of delay candidates (i.e., L delay candidates) in a predetermined range, calculates an error power with respect to an inputted speech signal, and outputs a combination of a quantization candidate and a delay which minimize the error power.

In the apparatus and method according to the third aspect of the present invention, the spectral parameter and delay calculator calculates spectral parameters and a first delay from a past excitation signal and an inputted speech signal, calculates a pitch predictive signal with respect to combinations of a plurality of quantization candidates (e.g., M quantization candidates) for spectral parameters and a plurality of second delay candidates (e.g., Q second delay candidates) determined in the vicinity of the first delay, calculates an error power with respect to the inputted speech signal, and outputs a combination of a quantization candidate and a second delay candidate which minimize the error power.

In the apparatus and method according to the fourth aspect of the present invention, the spectral parameter and delay calculator calculates spectral parameters and a first delay from a past drive signal and an inputted speech signal. A predictive residual signal is used as the drive signal. The spectral parameter and delay calculator calculates a pitch predictive signal with respect to combinations of a plurality of quantization candidates (e.g., M quantization candidates) for spectral parameters and a plurality of second delay candidates (e.g., Q second delay candidates) determined in the vicinity of the first delay, calculates an error power with respect to the inputted speech signal, and outputs a combination of a quantization candidate and a second delay candidate which minimize the error power.

In the apparatus and method according to the fifth aspect of the present invention, the mode decision unit determines a feature amount from an inputted speech signal, and classifies the speech signal into one of a plurality of modes using the feature amount. There are four types of modes as follows:

Mode 0: unvoiced/consonant part,

Mode 1: transient part,

Mode 2: weak steady part of a vowel,

Mode 3: strong steady part of a vowel.

If the mode of the inputted speech signal is a predetermined mode, then the apparatus and method according to the fifth aspect of the present invention operate in the same manner as the apparatus and method according to the first aspect of the present invention.

If the mode of the inputted speech signal is a predetermined mode, then the apparatus and method according to the sixth aspect of the present invention operate in the same manner as the apparatus and method according to the second aspect of the present invention.

If the mode of the inputted speech signal is a predetermined mode, then the apparatus and method according to the seventh aspect of the present invention operate in the same manner as the apparatus and method according to the third aspect of the present invention.

If the mode of the inputted speech signal is a predetermined mode, then the apparatus and method according to the eighth aspect of the present invention operate in the same manner as the apparatus and method according to the fourth aspect of the present invention.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 1:
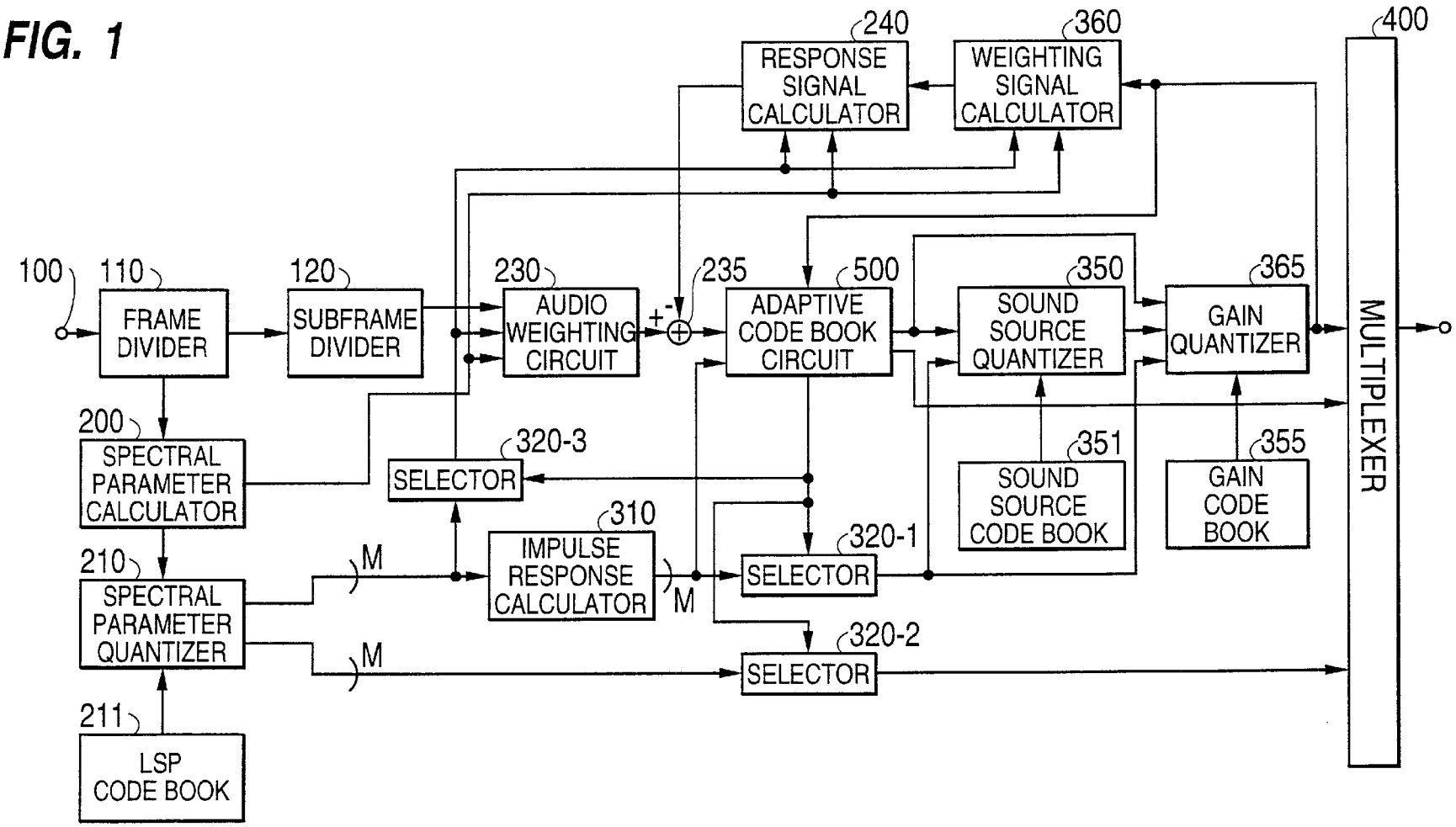
FIG. 1 is a block diagram of a speech signal coding apparatus according to a first embodiment of the present invention.

FIG. 1 shows in block form a speech signal coding apparatus according to a first embodiment of the present invention.

As shown in FIG. 1, a speech signal is supplied to the speech signal coding apparatus from an input terminal 100. A frame divider 110 divides the supplied speech signal into frames each of 10 ms, for example, and a subframe divider 120 divides the speech signal in each of the frames into subframes each of 2.5 ms, for example, shorter than the frames.

A spectral parameter calculator 200 sets up a window of 24 ms, for example, longer than the subframe interval with respect to the speech signal of at least one subframe to scissor a voice, and calculates spectral parameters with a predetermined order (e.g., P=12th order). Spectral parameters may be calculated according to a known analysis such as LPC analysis, Burg analysis, or the like. In this embodiment, the Burg analysis is used to calculate spectral parameters.

For details of the Burg analysis, reference should be made to Nakamizo "Signal analysis and system identification", pp. 82 –87, published in 1988 by Corona Co. Ltd. (hereinafter referred to as "document 4").

The spectral parameter calculator 200 also converts linear predictive coefficients $\alpha_i$ (i=1, 2, . . . , 10) calculated according to the Burg process into LSP parameters suitable for quantization and interpolation. For converting linear predictive coefficients into LSP parameters, reference should be made to Sugamura, et al. "Speech information compression using linear spectrum pair (LSP) speech analysis and synthesis", Journal of Electronic Communication Society, J64-A, pp. 599–606, 1981 (hereinafter referred to as "document 5").

For example, the spectral parameter calculator 200 converts linear predictive coefficients determined in second and fourth frames according to the Burg process into LSP parameters, determines LSP parameters in first and third frames according to linear interpolation, converts the LSP parameters in first and third frames back into linear predictive coefficients, and outputs the linear predictive coefficients $\alpha_{il}$ (i=1, 2, . . . ,10, l=1, 2, . . . ,5) in the first through fourth subframes to an audio weighting circuit 230. The spectral parameter calculator 200 also outputs the LSP parameters in the fourth subframe to a spectral parameter quantizer 210.

The spectral parameter quantizer 210 efficiently quantizes LSP parameters in predetermined subframes, and outputs quantized values of a plurality of M candidates (M≧2) in the order of increasing distortions $D_j$ expressed by the following equation:

$$D_j = \sum_i^p W(i)\,[LSP(i) - QLSP(i)_j]^2 \tag{1}$$

where LSP (i), QLSP (i) $_j$, W (i) represent an ith—order LSP parameter before quantization, a jth result after quantization, and a weighting coefficient, respectively, and p represents the order which is 10 below.

It is assumed that vector quantization will be used as a quantization process, and LSP parameters in the fourth subframe will be quantized. The LSP parameters may be quantized by a known vector quantization process. Specifically, such a known vector quantization process may be the vector quantization process as disclosed in Japanese laid-open patent publication No. 4-171500 (hereinafter referred to as "document 6"), Japanese laid-open patent publication No. 4-363000 (hereinafter referred to as "document 7"), Japanese laid-open patent publication No. 5-6199 (hereinafter referred to as "document 8"), or T. Nomura, et al. "LSP Coding Using VQ-SVQ With Interpolation in 4.075 Kbps M-LCELP Speech Coder", Proc. Mobile Multimedia Communications, pp. B.2.5, 1993 (hereinafter referred to as "document 9"), for example.

The spectral parameter quantizer 210 also restores the LSP parameters in the first through fourth subframes based on the quantized LSP parameters in the fourth subframe. Specifically, the spectral parameter quantizer 210 restores the LSP parameters in the first through third subframes by linearly interpolating the quantized LSP parameters in the fourth subframe of the present frame and the quantized LSP parameters in the fourth subframe of the preceding frame.

After selecting one type of a code vector for minimizing any error power between LSP parameters before quantization and LSP parameters after quantization, the spectral parameter quantizer 210 can restore the LSP parameters in the first through fourth subframes by way of linear interpolation. For improved performance, after selecting a plurality of candidates for a code vector for minimizing the error power, the spectral parameter quantizer 210 can evaluate each of the candidates for an accumulated distortion and select a combination of the candidate and interpolated LSP parameters which minimize the accumulated distortion. For details, reference should be made to Japanese laid-open patent publication No. 6-222797 (hereinafter referred to as "document 10"), for example.

The spectral parameter quantizer 210 converts the restored LSP parameters in the first through third subframes and the quantized LSP parameters in the fourth subframe into linear predictive coefficients $\alpha_{il}'$ (i=1, 2, . . . ,10, l=1, 2, . . . ,5) in each of the subframes, and outputs the linear predictive coefficients $\alpha_{il}'$ to an impulse response calculator 310. The spectral parameter quantizer 210 also outputs indexes representing code vectors of the quantized LSP parameters in the subframes to a multiplexer 400.

Instead of restoring the LSP parameters in the first through fourth subframes by way of linear interpolation, as many interpolating patterns for LSP parameters as the number of given bits, e.g., 2 bits, may be employed, and the LSP parameters in the first through fourth subframes may be restored with respect to each of the interpolating patterns to select a combination of a code vector and an interpolating pattern which minimize an accumulated distortion. This process allows time-dependent changes of the LSP parameters in the frames to be represented with greater precision though the transmitted information increases by the number of bits of the interpolating patterns. The interpolating patterns may be generated through a learning process using LSP data for training purpose, or predetermined patterns may be stored as the interpolating patterns. The predetermined patterns may be those described in T. Taniguchi, et. al. "Improved CELP Speech Coding at 4 kb/s and below", Proc. ICSLP, pp. 41–44, 1992 (hereinafter referred to as "document 11"). For improved performance, after an interpolating pattern is selected, an error signal may be determined between true LSP parameters and interpolated LSP parameters, and the error signal may be represented by an error code book.

The audio weighting circuit 230 is supplied with the linear predictive coefficients $\alpha_{il}$ (i=1, 2, . . . ,10, l=1, 2, . . . ,5) before quantization in each of the subframes from the spectral parameter calculator 200, effects audio weighting on the speech signal in the subframes based on the document 1, and outputs the weighted signal.

A response signal calculator 240 is supplied with the linear predictive coefficients $\alpha_{il}'$ in each of the subframes from the spectral parameter calculator 200, and also with the linear predictive coefficients $\alpha_{il}'$ restored according to quantization and interpolation in each of the subframes from the spectral parameter quantizer 210, calculates a response signal for one subframe with an input signal d (n)=0, using a stored value of a filter memory, and outputs the calculated response signal to a subtractor 235. The response signal, indicated by $x_z$ (n), is expressed according to the following equation (2):

$$x_z(n) = d(n) - \sum_{i=1}^{10} \alpha_i d(n-i) + \sum_{i=1}^{10} \alpha_i \gamma^i y(n-i) + \sum_{i=1}^{10} \alpha_i' \gamma^i x_z(n-i) \tag{2}$$

where γ is a weighting coefficient for controlling the amount of audio weighting.

The subtractor 235 produces a value $x_w'$ (n) by subtracting the response signal for one subframe from the weighted signal according to the equation (3) given below, and outputs the value $x_w'$ (n) to an adaptive code book circuit 500.

$$x'_w(n)=x_w(n)-x_z(n) \tag{3}$$

The impulse response calculator 310 calculates an impulse response hw (n) of a weighting filter whose z—transform is expressed according to the equation (4) given below, for a predetermined number of points L, and outputs the impulse response $h_w$ (n) to the adaptive code book circuit 500 and a excitation quantizer 350.

$$H_w(z) = \frac{1 - \sum_{i=1}^{10} \alpha_i z^{-i}}{1 - \sum_{i=1}^{10} \alpha_i \gamma^i z^{-i}} \quad \frac{1}{1 - \sum_{i=1}^{10} \alpha'_i \gamma^i z^{-i}} \tag{4}$$

Figure 2:
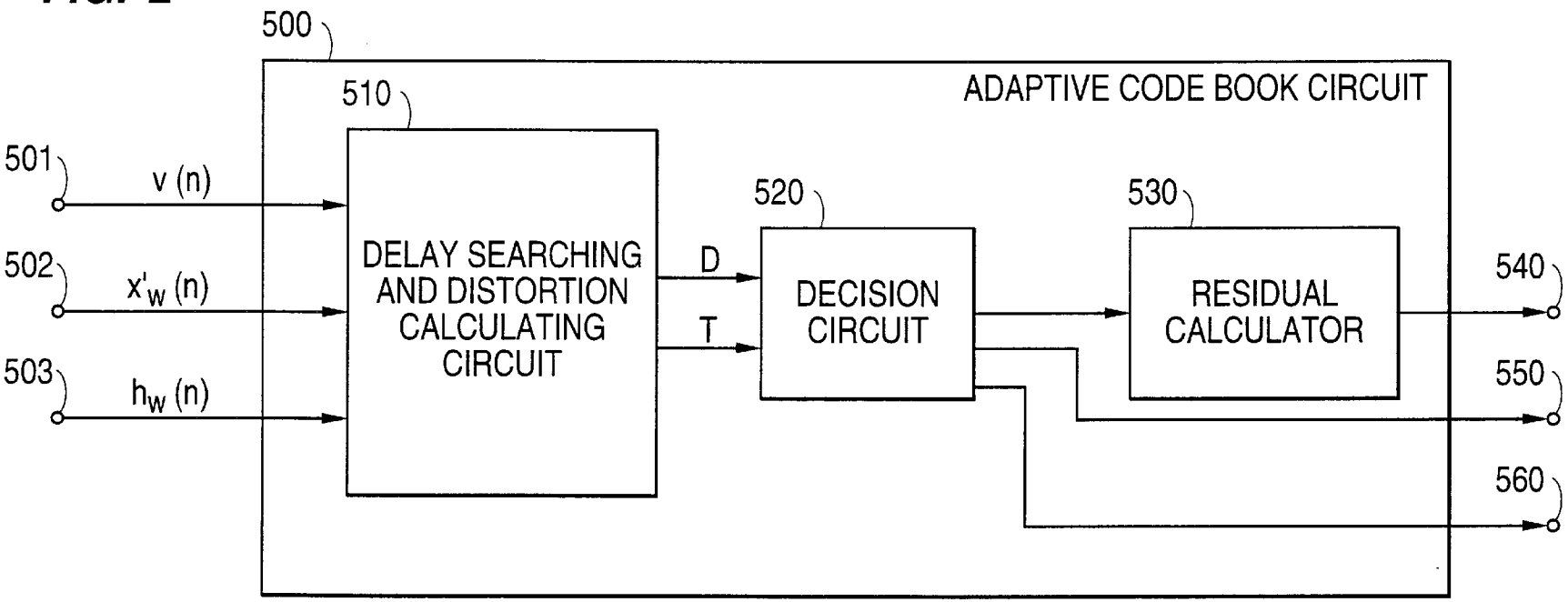
FIG. 2 is a block diagram of an adaptive code book circuit of the speech signal coding apparatus shown in FIG. 1.

The adaptive code book circuit 500 is shown in detail in FIG. 2. As shown in FIG. 2, the adaptive code book circuit 500 has a delay searching and distortion calculating circuit 510 which is supplied with a past excitation signal v (n), the output signal $x_w'$ (n) of the subtractor 235, and the impulse response $h_w$ (n) from respective input terminals 501, 502, 503. The impulse response is supplied in as many types as the number M of candidates for spectral parameter quantization. For each of the impulse responses, a delay T with respect to a pitch is determined in order to minimize a distortion DT given by the following equation (5):

$$D_T = \sum_{n=0}^{N-1} x'^2_w(n) - \left[ \sum_{n=0}^{N-1} x'_w(n) y_w(n-T) \right]^2 \Big/ \left[ \sum_{n=0}^{N-1} y_w^2(n-T) \right]^2 \tag{5}$$

where $y_w$ (n−T) is expressed according to the following equation (6) where * represents a convolutional operation:

$$y_W(n-T)=v(n-T)*h_W(n) \tag{6}$$

A gain β can be determined according to the following equation (7):

$$\beta = \sum_{n=0}^{N-1} x'_W(n) y_W(n-T) \Big/ \sum_{n=0}^{N-1} y_W^2(n-T) \tag{7}$$

The calculation of the equation (5) is repeated as many times as the number M of quantization candidates outputted from the spectral parameter quantizer 210, and the delay T and the distortion $D_T$ for each candidate are outputted to a decision circuit 520. Stated otherwise, a delay is determined with respect to each of the quantization candidates M, a speech signal is generated from a past excitation signal for each delay and each of the quantization candidates, and a quantization candidate and a delay for minimizing the distortion of the speech signal are outputted.

In order to increase the accuracy of extracting a delay with respect to female and child voices, delays may be determined not in terms of integer samples but in terms of decimal samples. For details, reference should be made to P. Kroon "Pitch predictors with high temporal resolution", Proc. ICASSP, pp. 661–664, 1990 (hereinafter referred to as "document 12").

The decision circuit 520 is supplied with M distortions and M delays, outputs a delay which minimizes the distortions to a residual calculator 530, and also outputs an index representing the selected delay from a terminal 550 to the multiplexer 400. The decision circuit 520 also outputs a decision signal from a terminal 560 to selectors 320-1, 320-2, 320-3.

The residual calculator 530 effects pitch prediction according the equation (8) given below, and outputs an adaptive code book predictive residual signal z (n) through a terminal 540 to the excitation quantizer 350.

$$z(n)=x'_W(n)-\beta v(n-T)*h_W(n) \tag{8}$$

In FIG. 1, the selectors 320-1, 320-2, 320-3 are supplied with the decision signal from the adaptive code book circuit 500. The selector 320-1 outputs an impulse response corresponding to the selected spectral parameter quantization candidate to the excitation quantizer 350 and a gain quantizer 365. The selector 320-2 outputs an index corresponding to the selected spectral parameter quantization candidate to the multiplexer 400. The selector 320-3 outputs the selected spectral parameter quantization candidate to the response signal calculator 240 and a weighting signal calculator 360.

The excitation quantizer 350 quantizes a excitation signal by searching for a code vector stored in a excitation code book 351. Specifically, the excitation quantizer 350 selects a best excitation code vector $c_j$ (n) in order to minimize an equation. The excitation quantizer 350 may select one best code vector, or may provisionally select two or more code vectors from which one code vector may be selected upon gain quantization. It is assumed here that two or more code vectors are selected according to the following equation (9):

$$D_j = \sum_{n}^{N-1} [z(n) - \gamma_j c_j(n) * h_W(n)]^2 \quad (9)$$

The gain quantizer 365 reads a gain code vector from a gain code book 355, and selects a combination of a sound code vector and a gain code vector for minimizing the equation (10) given below with respect to the selected sound code vector. An example of simultaneous vector quantization of both a gain of the adaptive code book and a gain of the excitation book is illustrated here.

$$D_{j,k} = \sum_{n}^{N-1} [x_W(n) - \beta'_k v(n-T) * h_W(n) - \gamma'_k c_j(n) * h_W(n)]^2 \quad (10)$$

For applying only the equation (10) to some excitation code vectors, a plurality of excitation code vectors may be preliminarily selected, and the equation (10) may be applied to the preliminarily selected excitation code vectors.

In the equation (10), $\beta'_k$, $\gamma'_k$ represent kth code vectors in a two-dimensional gain code book stored in the gain code book 355. The gain quantizer 365 outputs an index representing the excitation code vector and the gain code vector which are selected to the multiplexer 400.

The weighting signal calculator 360 is supplied with the output parameters from the spectral parameter calculator 200 and their respective indexes, reads corresponding code vectors from the indexes, and determines a drive excitation signal v (n) according to the following equation (11):

$$v(n) = g'(1)v(n-T) + g'(2)c_j(n) \quad (11)$$

Then, the weighting signal calculator 360 calculates a response signal $s_w$ (n) in each subframe according to the following equation (12), using the output parameters from the spectral parameter calculator 200 and the output parameters from the spectral parameter quantizer 210, and outputs the response signal sw (n) to the response signal calculator 240:

$$s_W(n) = v(n) - \sum_{i=1}^{10} a_i v(n-i) + \sum_{i=1}^{10} a_i \gamma^i p(n-i) + \sum_{i=1}^{10} a'_i \gamma^i s_W(n-i) \quad (12)$$

Figure 3:
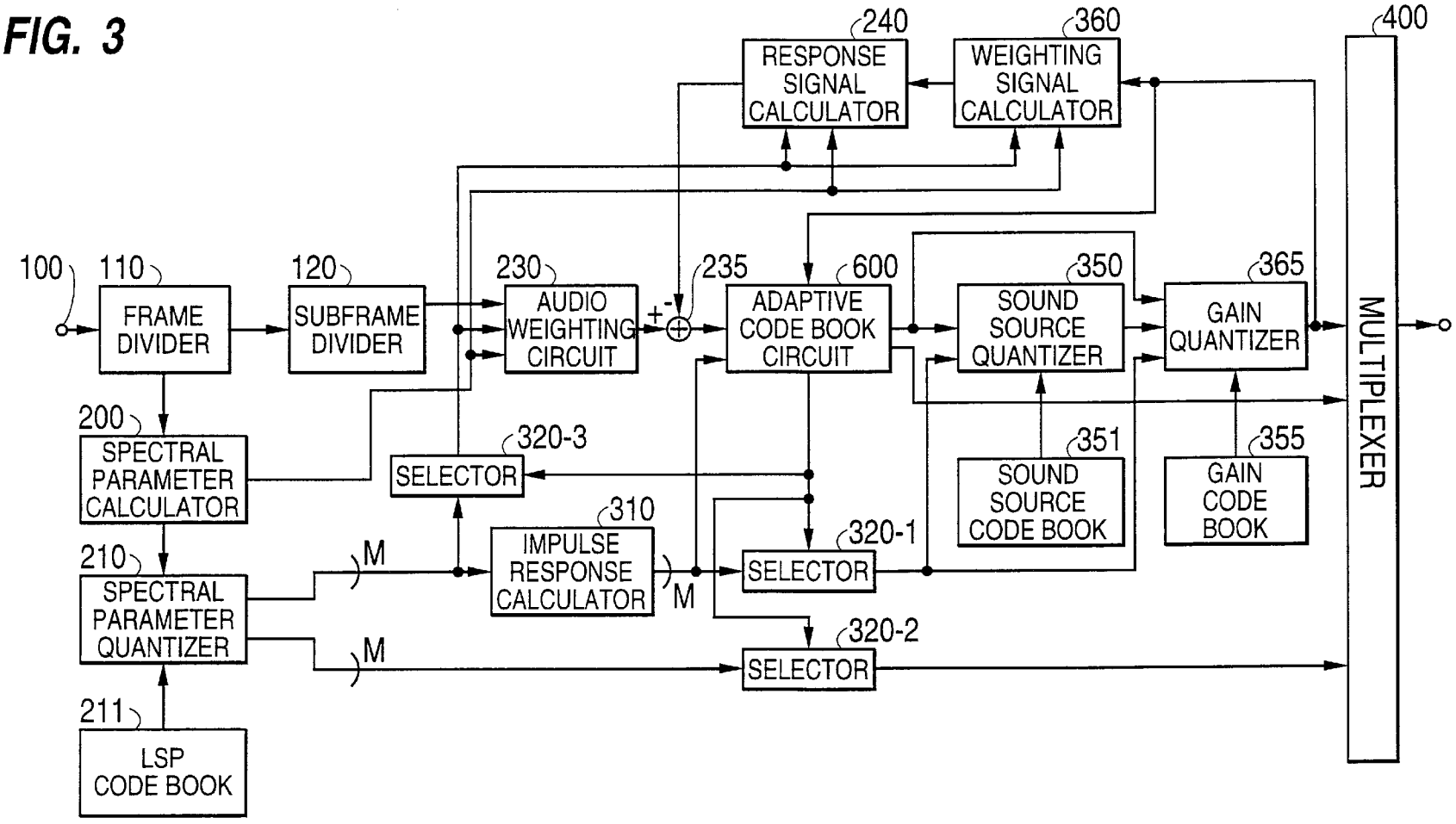
FIG. 3 is a block diagram of a speech signal coding apparatus according to a second embodiment of the present invention.

FIG. 3 shows in block form a speech signal coding apparatus according to a second embodiment of the present invention. Those parts shown in FIG. 3 which are identical to those shown in FIG. 1 operate identically to those shown in FIG. 1, and will not be described in detail below.

Figure 4:
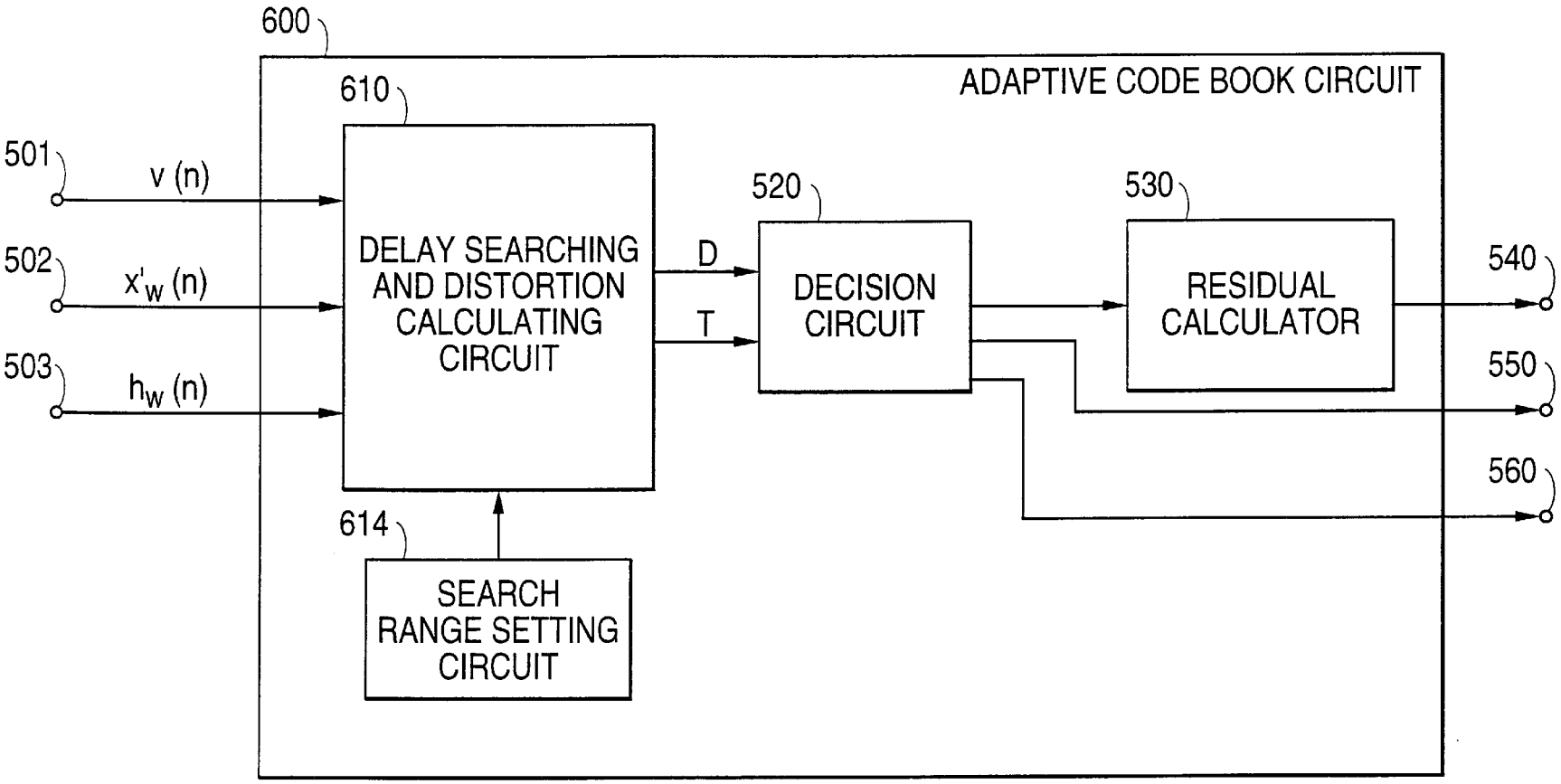
FIG. 4 is a block diagram of an adaptive code book circuit of the speech signal coding apparatus shown in FIG. 3.

An adaptive code book circuit 600 shown in FIG. 3 operates differently from the adaptive code book circuit 500 shown in FIG. 1, and will be described below with reference to FIG. 4. In FIG. 4, a search range setting circuit 614 presets a search range for delays. It is assumed here that the search range setting circuit 614 presets a search range L. A distortion calculator 610 calculates a distortion according to the equation (5) with respect to all combinations L, M of all delays in the search range L and M types of impulse responses, and outputs the value of the distortion and the delays to a decision circuit 520.

Figure 5:
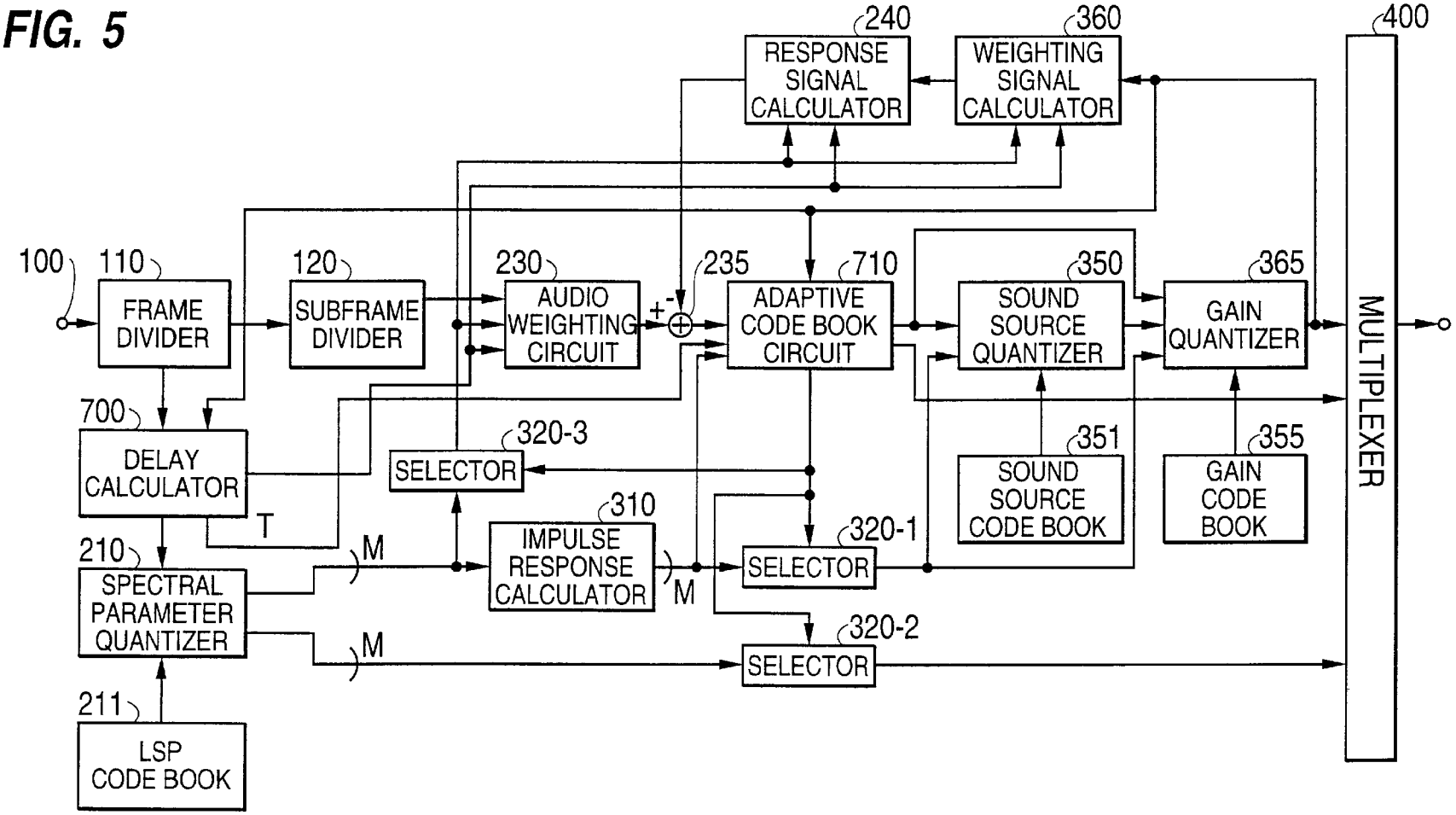
FIG. 5 is a block diagram of a speech signal coding apparatus according to a third embodiment of the present invention.

FIG. 5 shows in block form a speech signal coding apparatus according to a third embodiment of the present invention. Those parts shown in FIG. 5 which are identical to those shown in FIG. 1 operate identically to those shown in FIG. 1, and will not be described in detail below.

In FIG. 5, a spectral parameter and delay calculator 700 is supplied with an input speech signal x (n) and a past excitation signal v (n), and calculates spectral parameters $\alpha_i$ in order to minimize a distortion expressed by the following equation (13) with respect to each delay T in a predetermined first delay search range.

$$E_T = \sum_{n=0}^{N-1} \left[ x(n) - \left[ \beta v(n-T) + \sum_{i=1}^{10} \alpha_i x(n-i) \right] \right]^2, (T_1 \leqq T \leqq T_2) \quad (13)$$

A combination of a first delay and a spectral parameter for minimizing the distortion ET is selected. The first delay is outputted to an adaptive code book circuit 710, and the spectral parameter $\alpha_i$ is outputted to a spectral parameter quantizer 210.

Figure 6:
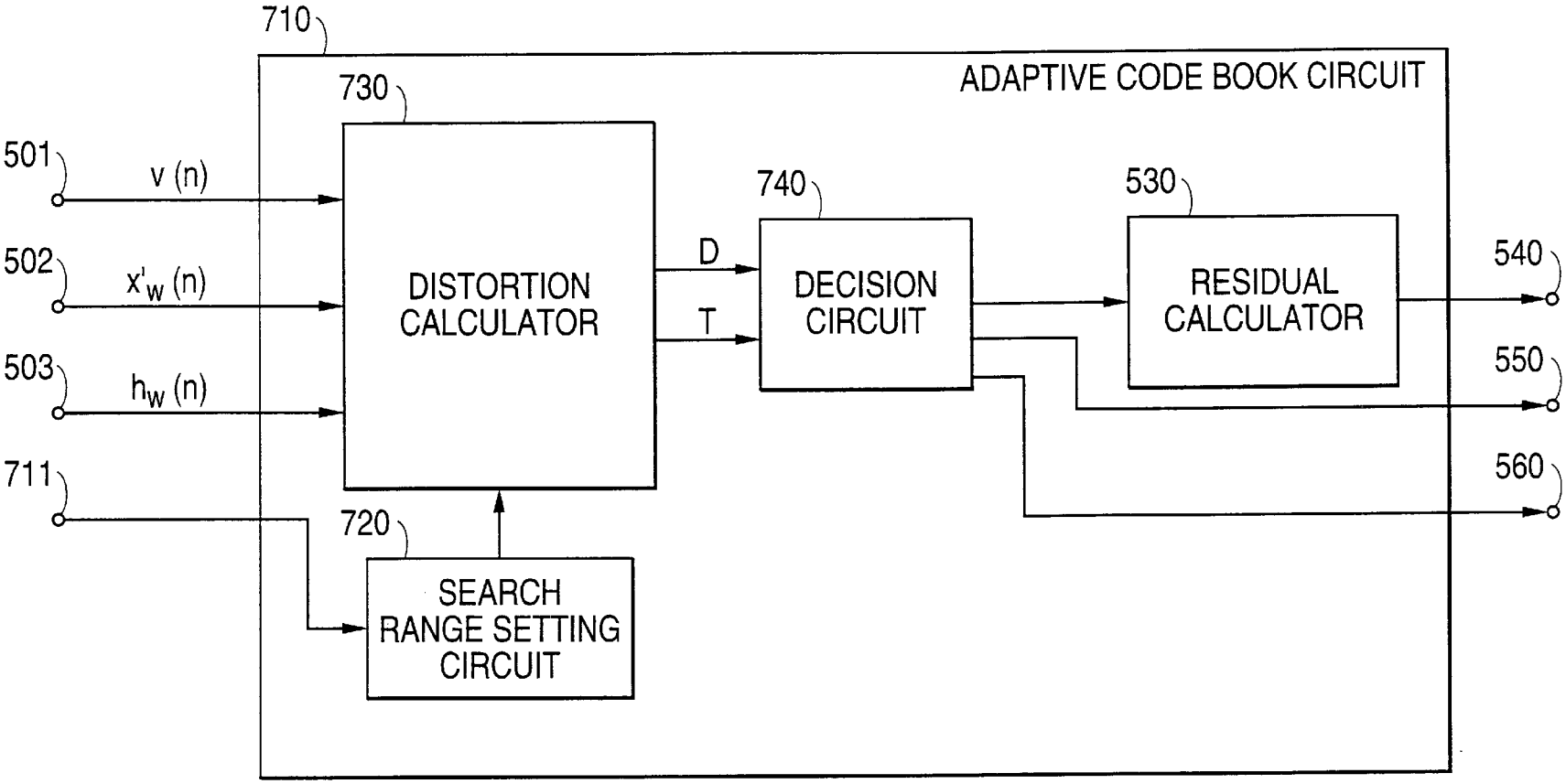
FIG. 6 is a block diagram of an adaptive code book circuit of the speech signal coding apparatus shown in FIG. 5.

FIG. 6 shows in detail the adaptive code book circuit 710 illustrated in FIG. 5. Those parts shown in FIG. 6 which are identical to those shown in FIG. 4 operate identically to those shown in FIG. 4, and will not be described in detail below.

In FIG. 6, the first delay is supplied from a terminal 711. A search range setting circuit 720 determines second a search range for second delay candidates in the vicinity of the first delay. A distortion calculator 730 fixes an impulse response, and determines a delay T for minimizing a distortion expressed by the equation (14) given below and a distortion at the time, with respect to each delay included in the search range. In this example, one type of a delay for minimizing the distortion expressed by the equation (14) is selected as a second delay with respect to one impulse response candidate.

$$D_T = \sum_{n=0}^{N-1} x'^2_W(n) - \left[ \sum_{n=0}^{N-1} x'_W(n) y_W(n-T) \right]^2 / \left[ \sum_{n=0}^{N-1} y_W^2(n-T) \right] \quad (14)$$

where $y_w$ (n−T) is expressed by the following equation (15) where * represents a convolutional operation:

$$y_W(n-T) = v(n-T) * h_W(n) \quad (15)$$

A gain β is then determined according to the following equation (16):

$$\beta = \sum_{n=0}^{N-1} x'_W(n) y_W(n-T) / \sum_{n=0}^{N-1} y_W^2(n-T) \quad (16)$$

The calculation of the equation (14) is repeated as many times as the number M of impulse response candidates, and the delay T and the distortion $D_T$ for each candidate are outputted to a decision circuit 740.

The decision circuit 740 is supplied with M distortions and M delays, selects a delay for minimizing the distortion as a second delay, outputs the selected delay to a residual calculator 530, and outputs an index representing the selected delay from a terminal 550 to a multiplexer 400. The decision circuit 740 also outputs a decision signal from a terminal 560 to selectors 320-1, 320-2, 320-3.

Figure 7:
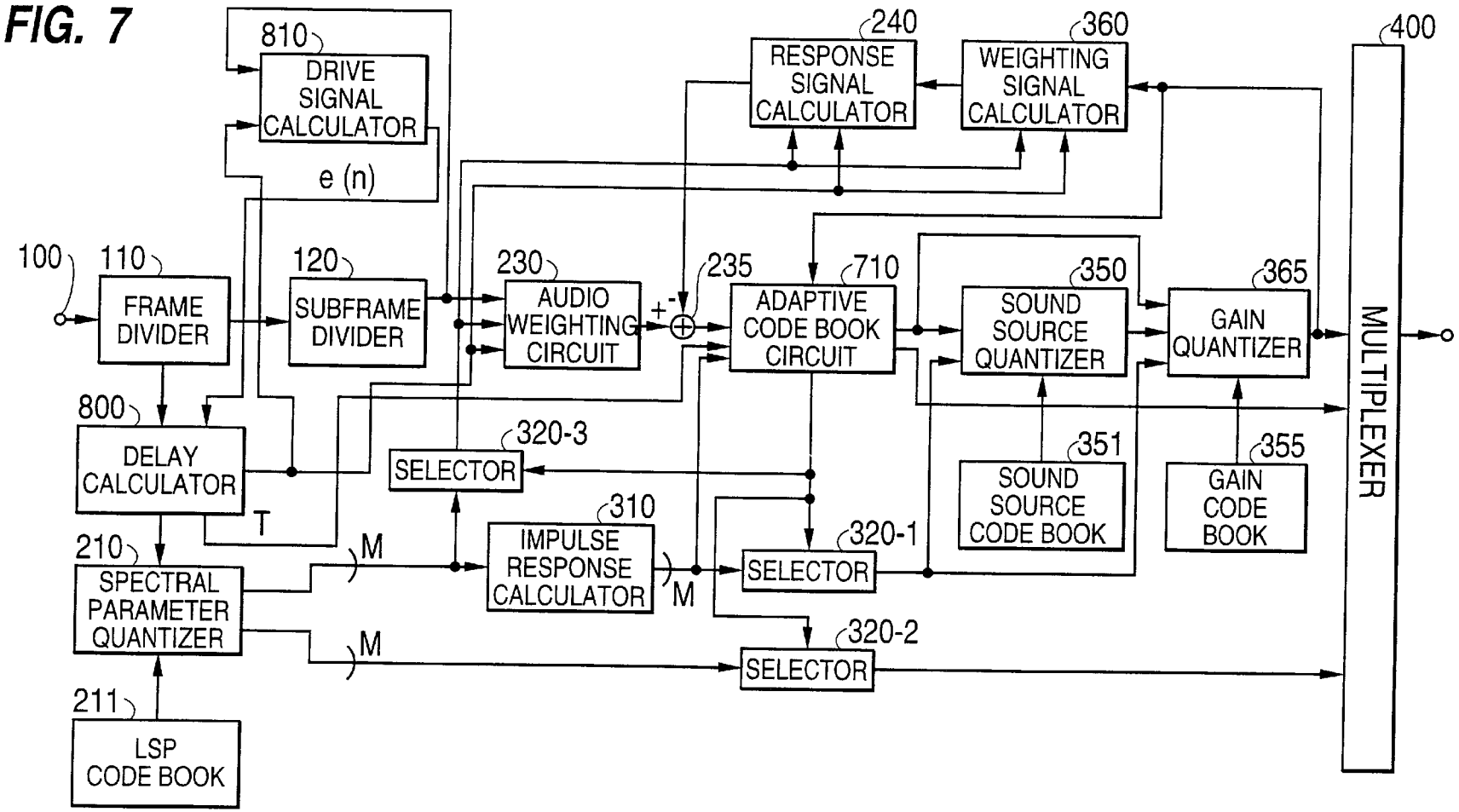
FIG. 7 is a block diagram of a speech signal coding apparatus according to a fourth embodiment of the present invention.

FIG. 7 shows in block form a speech signal coding apparatus according to a fourth embodiment of the present invention. Those parts shown in FIG. 7 which are identical to those shown in FIG. 1 or 5 operate identically to those shown in FIG. 1 or 5, and will not be described in detail below.

In FIG. 7, a spectral parameter and delay calculator 800 is supplied with an input speech signal x (n) and a past excitation signal e (n), and calculates spectral parameters $\alpha_i$ in order to minimize a distortion expressed by the following equation (17) with respect to each delay T in a predetermined first delay search range.

$$E_T = \sum_{n=0}^{N-1} \left[ x(n) - \left[ \beta e(n-T) + \sum_{i=1}^{10} \alpha_i x(n-i) \right] \right]^2, (T_1 \leqq T \leqq T_2) \quad (17)$$

A combination of a first delay and a spectral parameter for minimizing the distortion $E_T$ is selected. The first delay is outputted to an adaptive code book circuit 710, and the spectral parameter $\alpha_i$ is outputted to a spectral parameter quantizer 210.

After the calculations are carried out by the spectral parameter and delay calculator 800, a drive signal calculator 810 is supplied with a speech signal divided into subframes from a subframe divider 120 and spectral parameters from the spectral parameter and delay calculator 800, calculates a predictive residual signal e (n) for a subframe length according to the following equation (18), and stores the calculated predictive residual signal e (n) as a drive signal:

$$e(n) = x(n) - \sum_{i=1}^{10} \alpha_i x(n-i), (n = 0, \ldots, N-1) \quad (18)$$

Figure 8:
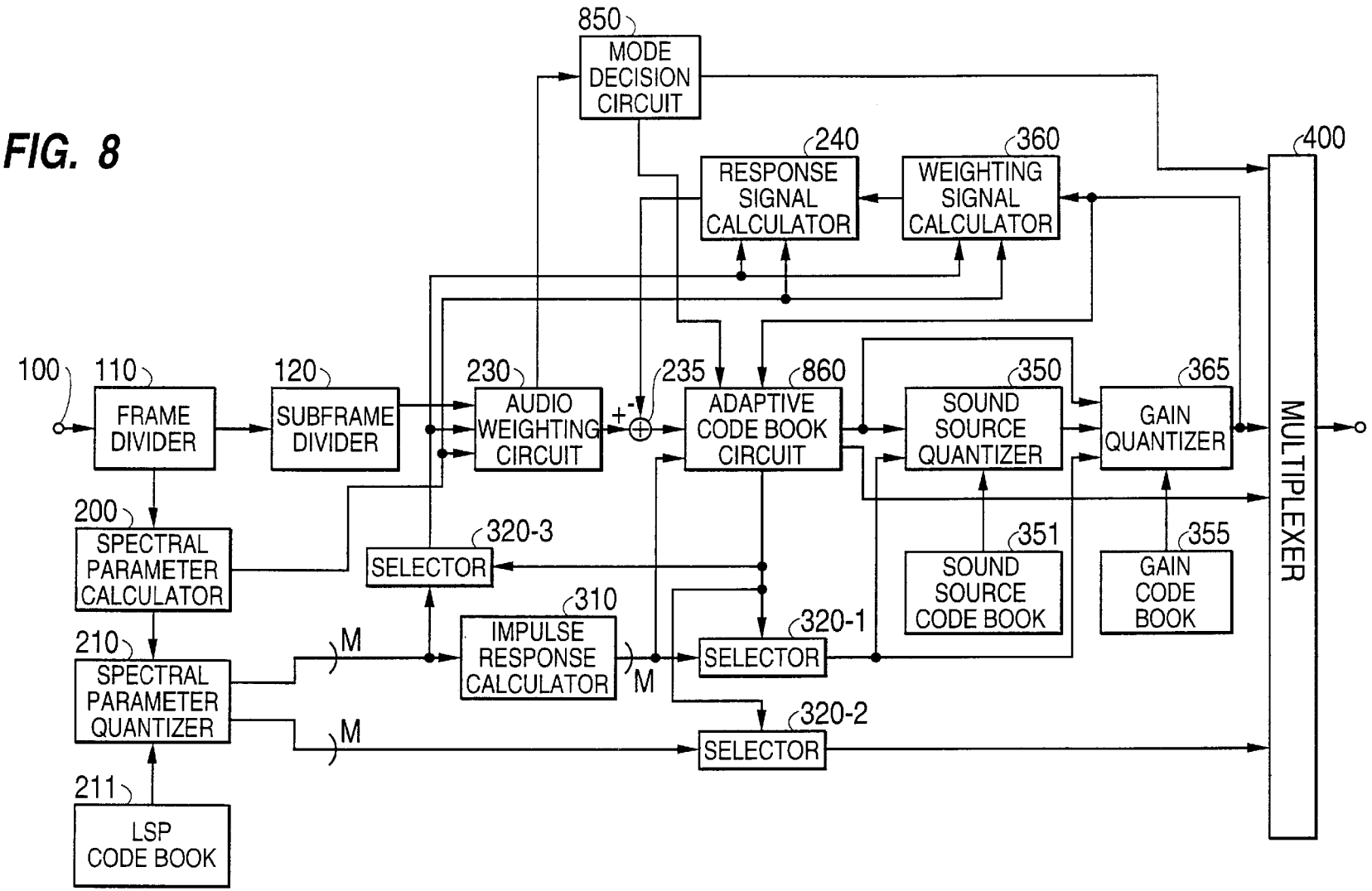
FIG. 8 is a block diagram of a speech signal coding apparatus according to a fifth embodiment of the present invention.

FIG. 8 shows in block form a speech signal coding apparatus according to a fifth embodiment of the present invention. Those parts shown in FIG. 8 which are identical to those shown in FIG. 1 operate identically to those shown in FIG. 1, and will not be described in detail below. In FIG. 8, a mode decision circuit 850 receives a weighted signal in each frame from an audio weighting circuit 230, and outputs mode decision information. In this embodiment, the following four modes are employed:

Mode 0: unvoiced/consonant part,

Mode 1: transient part,

Mode 2: weak steady part of a vowel,

Mode 3: strong steady part of a vowel.

In this embodiment, a feature amount, such as a pitch predictive gain, for example, of a present frame is used to decide a mode. A pitch predictive gain is calculated according to the following equations (19)~(21), for example:

$$G = 10\log_{10}[P/E] \quad (19)$$

$$P = \sum_{n=0}^{N-1} x_W^2(n) \quad (20)$$

$$E = P - \left[ \sum_{n=0}^{N-1} x_W(n) x_W(n-T) \right]^2 / \left[ \sum_{n=0}^{N-1} x_W^2(n-T) \right] \quad (21)$$

where T is an optimum delay for maximizing the pitch predictive gain.

The pitch predictive gain is compared with a plurality of predetermined thresholds and classified into one of plural types of modes. A mode decision circuit 850 outputs the mode decision information to an adaptive code book circuit 860 and a multiplexer 400. The adaptive code book circuit 860 supplied with the mode decision information. If the mode decision information represents a predetermined mode, the adaptive code book circuit 860 operates in the same manner as the adaptive code book circuit 500 shown in FIG. 1, calculates a delay, and outputs the delay and an index indicative of the delay.

The mode is decided as described above because while in the strong steady part of a vowel in the mode 3, the speech signal can be coded highly efficiently due to large pitch periodicity, the pitch periodicity is small and many errors tend to occur in the other modes. In this embodiment, any coding according to an adaptive code book is not carried out in those modes in which the speech signal cannot be coded highly efficiently, so that the overall operation of the apparatus is made highly efficient.

Figure 9:
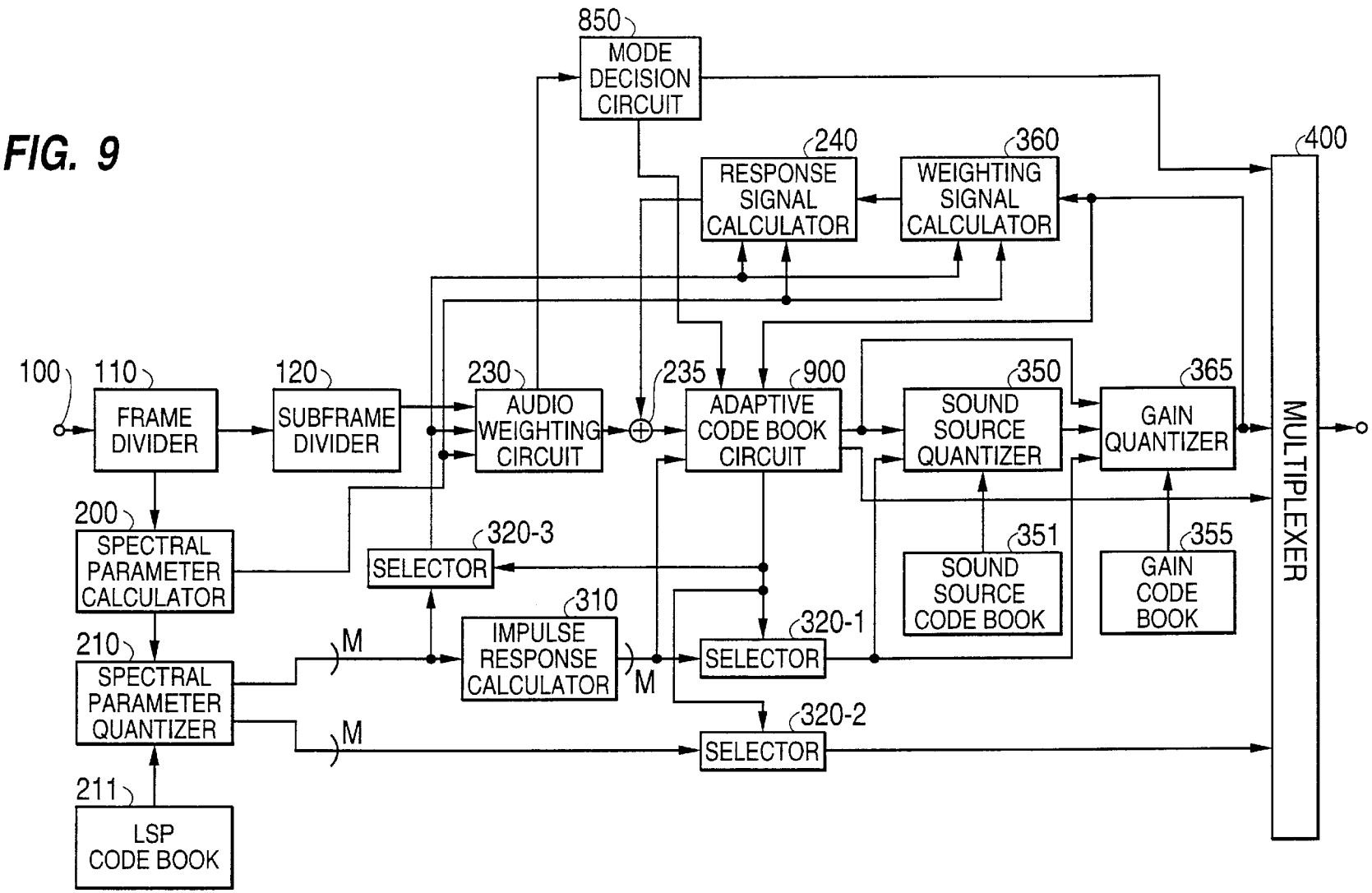
FIG. 9 is a block diagram of a speech signal coding apparatus according to a sixth embodiment of the present invention.

FIG. 9 shows in block form a speech signal coding apparatus according to a sixth embodiment of the present invention. Those parts shown in FIG. 9 which are identical to those shown in FIG. 3 or 8 operate identically to those shown in FIG. 3 or 8, and will not be described in detail below.

In FIG. 9, an adaptive code book circuit 900 is supplied with mode decision information from a mode decision circuit 850. If the mode decision information represents a predetermined mode, the adaptive code book circuit 900 operates in the same manner as the adaptive code book circuit 600 shown in FIG. 3, calculates a delay, and outputs the delay and an index indicative of the delay.

Figure 10:
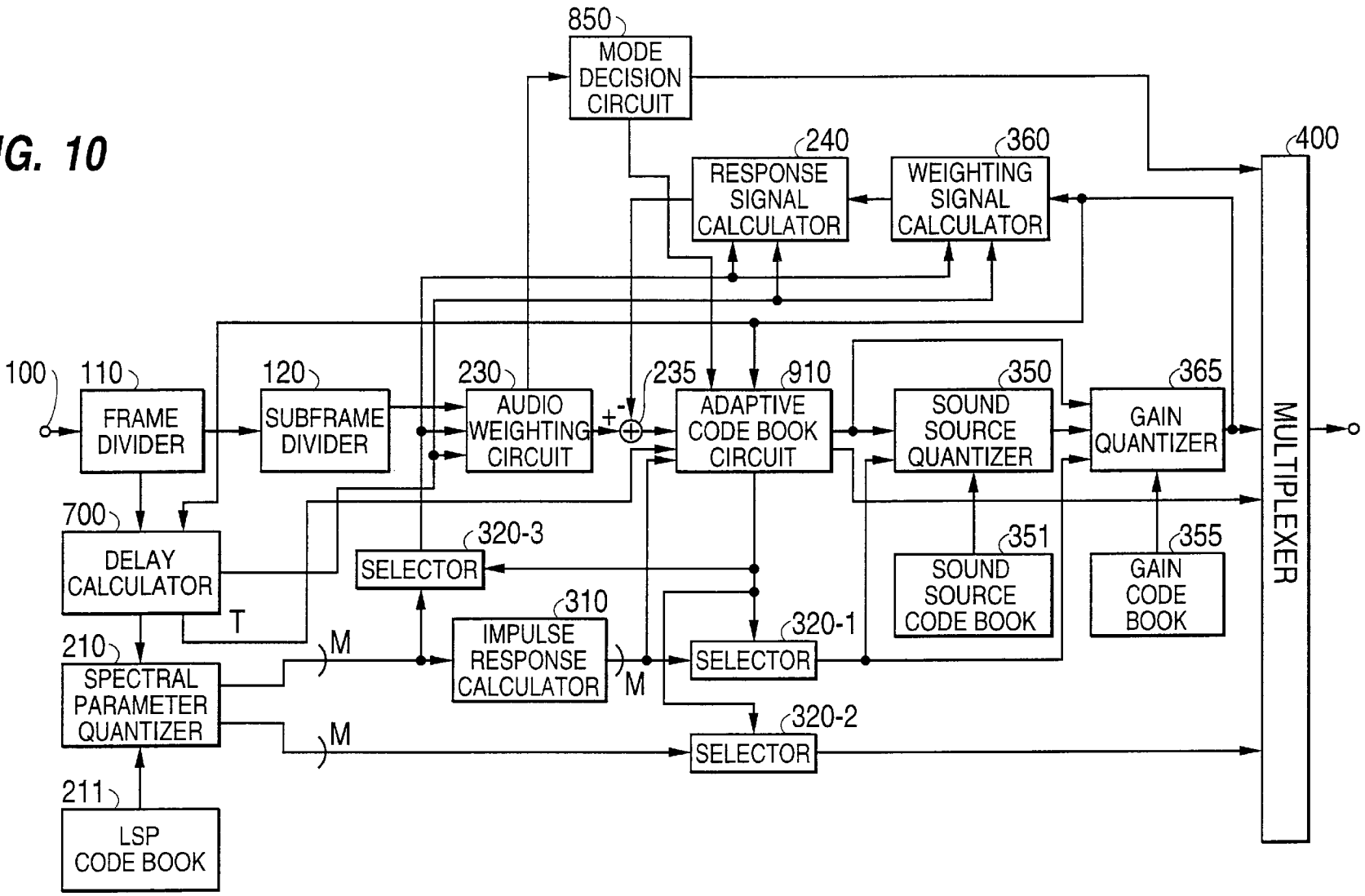
FIG. 10 is a block diagram of a speech signal coding apparatus according to a seventh embodiment of the present invention.

FIG. 10 shows in block form a speech signal coding apparatus according to a seventh embodiment of the present invention. Those parts shown in FIG. 10 which are identical to those shown in FIG. 5 or 8 operate identically to those shown in FIG. 5 or 8, and will not be described in detail below.

In FIG. 10, an adaptive code book circuit 910 is supplied with mode decision information from a mode decision circuit 850. If the mode decision information represents a predetermined mode, the adaptive code book circuit 910 operates in the same manner as the adaptive code book circuit 710 shown in FIG. 5, calculates a delay, and outputs the delay and an index indicative of the delay.

Figure 11:
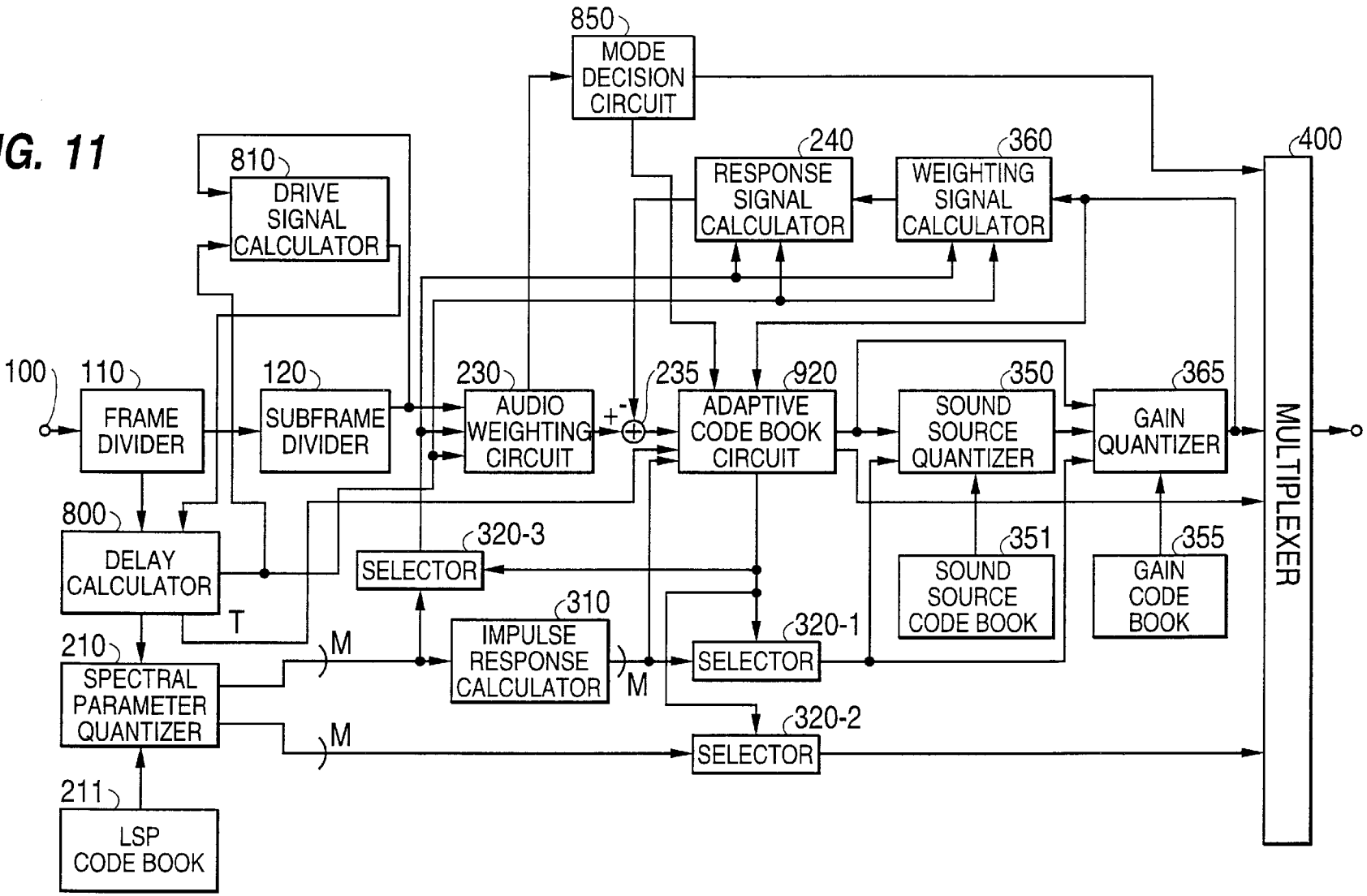
FIG. 11 is a block diagram of a speech signal coding apparatus according to an eighth embodiment of the present invention.

FIG. 11 shows in block form a speech signal coding apparatus according to an eighth embodiment of the present invention. Those parts shown in FIG. 11 which are identical to those shown in FIG. 7 or 8 operate identically to those shown in FIG. 7 or 8, and will not be described in detail below.

In FIG. 11, an adaptive code book circuit 920 is supplied with mode decision information from a mode decision circuit 850. If the mode decision information represents a predetermined mode, the adaptive code book circuit 920 operates in the same manner as the adaptive code book circuit 710 shown in FIG. 7, calculates a delay, and outputs the delay and an index indicative of the delay.

In the above embodiments, only one second delay candidate has been described above. However, a plurality of second delay candidates may be employed.

The excitation code book for the excitation quantizer may be of any of other known arrangements, e.g., a multistage arrangement or a sparse arrangement.

It is possible to switch between adaptive code book circuits and also between excitation code books for the excitation quantizer, using mode decision information.

In the above embodiments, the excitation quantizer searches the excitation code book. However, the excitation quantizer may search a plurality of multipulses having different positions and amplitudes. The amplitudes and positions of multipulses may be determined in order to minimize the following equation (22):

$$D = \sum_{n=0}^{N-1} \left[ x_W(n) - \sum_{j=1}^{k} g_j h_W(n-m_j) \right]^2 \quad (22)$$

where $g_j$, $m_j$ represent the amplitude and position of a jth multipulse, and k the number of multipulses.

According to the present invention, as described above, delays in an adaptive bode book are determined with respect to a plurality of quantization candidates for spectral parameters, and the best of all combinations of the delays and the quantization candidates is selected. Spectral parameters and a first delay are simultaneously calculated, at least one second delay is calculated based on the first delay with respect to the plurality of quantization candidates for spectral parameters, and the best of all combinations of the second delay and the quantization candidates is selected. The above processing is carried out with respect to only a predetermined mode. Therefore, it is possible for the coding process to be less subject to effects of a pitch and to determine spectral parameters taking quantization and delays in an adaptive code book into account. Consequently, the coding process according to the present invention can maintain good sound quality even if the bit rate is lowered, as compared with the conventional systems.

While preferred embodiments of the present invention have been described using specific terms, such description is for illustrative purposes only, and it is to be understood that changes and variations may be made without departing from the spirit or scope of the following claims.

What is claimed is:

1. An apparatus for coding a speech signal, comprising:

a spectral parameter calculator for determining spectral parameters from an inputted speech signal, quantizing the spectral parameters, and outputting a plurality of quantization candidates;

an adaptive code book for determining delays with respect to each of said quantization candidates outputted from said spectral parameter calculator, generating a pitch predictive signal based on a past excitation signal for each of the delays and associating quantization candidates, and outputting a quantization candidate and a delay which provide a minimum distortion between the speech signal and said pitch predictive signal;

a excitation quantizer for quantizing and outputting the excitation signal of said speech signal; and a gain quantizer for quantizing and outputting a gain of at least one of said adaptive code book and said quantized excitation signal.

2. An apparatus for coding a speech signal, comprising:

a spectral parameter calculator for determining spectral parameters from an inputted speech signal, quantizing the spectral parameters, and outputting a plurality of quantization candidates;

an adaptive code book for determing delay, generating delay candidates existing within predetermined delay range, generating a pitch predictive signal calculated using a signal extracted from a past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said quantized excitation signal; and a gain quantizer for quantizing and outputting a gain of at least one of said adaptive code book and said quantized excitation signal.

3. An apparatus for coding a speech signal, comprising:

a spectral parameter and delay calculator for calculating spectral parameters and a first delay from a signal extracted from a past excitation signal for a delay and an inputted speech signal;

a spectral parameter quantizer for quantizing the spectral parameters and outputting at least one quantization candidate;

an adaptive code book for determining a second delay based on said first delay, calculating at least one second delay candidate neighboring said first delay, generating a pitch predictive signal calculated using a signal extracted from a past excitation signal for said second delay candidate and quantization candidate, for all of the combinations between each of second delay candidates and each of quantization candidates;

an excitation quantizer for quantizing and outputting the excitation signal of said speech signal; and a gain quantizer for quantizing and outputting a gain of at least one of said adaptive code book and said quantized excitation signal.

4. An apparatus for coding a speech signal, comprising:

a spectral parameter and delay calculator for being supplied with an inputted speech signal, jointly calculating spectral parameters and a first delay from a signal scissored from a past drive signal for a delay and the inputted speech signal;

a drive signal calculator for calculating a drive signal from said spectral parameters and said speech signal;

a spectral parameter quantizer for quantizing the spectral parameters and outputting at least one quantization candidate;

an adaptive code book for determing second delay based on said first delay, calculating at least one second delay candidate neighboring said first delay, generating a pitch predictive signal calculated using a signal extracted from a past excitation signal for said second delay candidate and quantization candidate, for all of the combinations between each of second delay candidates and each of quantization candidates, a excitation quantizer for quantizing and outputting the excitation signal of said speech signal; and a gain quantizer for quantizing and outputting a gain of at least one of said adaptive code book and said quantized excitation signal.

5. An apparatus for coding a speech signal, comprising:

a mode decision unit for deciding a mode of an inputted speech signal and outputting mode decision information;

a spectral parameter calculator for determining spectral parameters from the speech signal, quantizing the spectral parameters, and outputting a plurality of quantization candidates;

an adaptive code book for determining delay with respect to each of said quantization candidates, respectively, outputted from said spectral parameter quantizer, generating a pitch predective signal based on a past excitation signal for each of the delays and associating quantization candidates, and outputting a quantization candidate and a delay which provide a minimum distortion between the speech signal and said pitch predective signal, if the mode decision information outputted from said mode decision unit represents a predetermined mode;

a excitation quantizer for quantizing and outputting the excitation signal of said speech signal; and a gain quantizer for quantizing and outputting a gain of at least one of said adaptive code book and said quantized excitation signal.

6. An apparatus for coding a speech signal, comprising:

a mode decision unit for deciding a mode of an inputted speech signal and outputting mode decision information;

a spectral parameter calculator for determining spectral parameters from the speech signal, quantizing the spectral parameters, and outputting a plurality of quantization candidates;

an adaptive code book for determining 'delay, generating delay candidates existing within predetermined delay range, generating a pitch predictive signal calculated using a signal extracted from a past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said pitch predective signal, if the mode decision information outputted from said mode decision unit represents a predetermined mode; and a gain quantizer for quantizing and outputting a gain of at least one of said adaptive code book and said quantized excitation signal.

7. An apparatus for coding a speech signal, comprising:

a mode decision unit for decoding a mode of an inputted speech signal and outputting mode decision information;

a spectral parameter calculator for determining spectral parameters from the speech signal, quantizing the spectral parameters, and outputting a plurality of quantization candidates;

a spectral parameter and delay calculator for calculating spectral parameters and a first delay from a signal extracted from a past excitation signal for a delay and an inputted speech signal;

a spectral parameter quantizer for quantizing the spectral parameters and outputting at least one quantization candidate;

an adaptive codebook code book for determining a second delay based on said first delay, calculating at least one second delay candidate neighboring said first delay, generating a pitch predictive signal calculated using a signal extracted from a past excitation signal for said second delay candidate and quantization candidate, for all of the combinations between each of second delay candidates and each of quantization candidates, if the mode decision information outputted from said mode decision unit represents a predetermined mode;

an excitation quantizer for quantizing and outputting the excitation signal of said speech signal; and a gain quantizer for quantizing and outputting a gain of at least one of said adaptive code book and said quantized excitation signal.

8. An apparatus for coding a speech signal, comprising:

a mode decision unit for deciding a mode of an inputted speech signal and outputting mode decision information;

a spectral parameter calculator and delay calculator for being supplied with an inputted speech signal, jointly calculating spectral parameters and a first delay from a signal extracted from a past drive signal for a delay and the inputted speech signal;

a drive signal calculator for calculating a drive signal from said spectral parameters and said speech signal;

a spectral parameter quantizer for quantizing the spectral parameters and outputting at least one quantization candidate;

an adaptive codebook code book for determining a second delay based on said first delay, calculating at least one second delay candidate neighboring said first delay, generating a pitch predictive signal calculated using a signal extracted from a past excitation signal for said second delay candidate and quantization candidate, for all of the combinations between each of second delay candidates and each of quantization candidates, if the mode decision information outputted from said mode decision unit represents a predetermined mode;

an excitation quantizer for quantizing and outputting the excitation signal of said speech signal; and a gain quantizer for quantizing and outputting a gain of at least one of said adaptive code book and said quantized excitation signal.

9. A method of coding a speech signal, comprising the steps of:

determining spectral parameters from an inputted speech signal, quantizing the spectral parameters, and outputting a plurality of quantization candidates; and determining delays with respect to said quantization candidates, generating a pitch predictive signal based on a past excitation signal for each of the delays and each of the quantization candidates, and determining a quantization candidate and a delay which provide a minimum distortion between the inputted speech signal and said pitch predictive signal.

10. A method of coding a speech signal, comprising the steps of:

determining spectral parameters from an inputted speech signal, quantizing the spectral parameters, and outputting a plurality of quantization candidates;

determining delay, generating delay candidates existing within predetermined delay range, generating a pitch predictive signal calculated using a signal extracted from a past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said quantized excitation signal.

11. A method of coding a speech signal, comprising the steps of:

calculating spectral parameters and a first delay from a signal extracted from a past excitation signal for a delay and an inputted speech signal;

determining at least one quantization candidate for said spectral parameters; and calculating at least one second delay based on said first delay, calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates.

12. A method of coding a speech signal, comprising the steps of:

inputting a speech signal, calculating spectral parameters and a first delay from a signal extracted from a past drive signal for a delay and the inputted speech signal;

calculating a drive signal from said spectral parameters and said speech signal;

determining at least one quantization candidate for said spectral parameters;

calculating at least one second delay based on said first delay, calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates.

13. A method of coding a speech signal, comprising the steps of:

deciding a mode of an inputted speech signal;

determining spectral parameters from the speech signal, quantizing the spectral parameters, and determining a plurality of quantization candidates; and determining a delay with respect to each of said quantization candidates, respectively, outputted from said spectral parameter quantizer, generating a pitch predective signal based on a past excitation signal for each of the delays and associating quantization candidates, and outputting a quantization candidate and a delay which provide a minimum distortion between the speech signal and said pitch predictive signal, if the mode decision information outputted from said mode decision unit represents a predetermined mode.

14. A method of coding a speech signal, comprising the steps of:

deciding a mode of an inputted speech signal;

determining spectral parameters from the speech signal, quantizing the spectral parameters, and determining a plurality of quantization candidates; and determining delay, generating delay candidates existing within predetermined delay range, generating a pitch predictive signal calculated using a signal extracted from past excitation signal for a delay candidate and quantization candidate, for each of all combinations between each of said delay candidates and each of quantization candidates, and outputting an optimal combination between a quantization candidate and a delay which provides a minimum distortion between the inputted speech signal and said pitch predective signal, if the mode decision information outputted from said mode decision unit represents a predetermined mode.

15. A method of coding a speech signal, comprising the steps of:

deciding a mode of an inputted speech signal;

determining spectral parameters from the speech signal, quantizing the spectral parameters, and determining a plurality of quantization candidates;

calculating spectral parameters and a first delay from a signal extracted from a past excitation signal for a delay and the inputted speech signal;

quantizing the spectral parameters and determining at least one quantization candidate; and calculating at least one second delay candidate neighboring said first delay, generating a pitch predictive signal calculated using a signal extracted from a past excitation signal for said second delay candidate and quantization candidate, for all of the combinations between each of second delay candidates and each of quantization candidates, if the mode decision information outputted from said mode decision unit represents a predetermined mode.

16. A method of coding a speech signal, comprising the steps of:

deciding a mode of an inputted speech signal;

calculating spectral parameters and a first delay from a signal extracted from a past drive signal for a delay and the inputted speech signal;

calculating a drive signal from said spectral parameters and said speech signal;

quantizing said spectral parameters and determining at least one quantization candidate; and calculating at least one second delay candidate neighboring said first delay, generating a pitch predictive signal calculated using a signal extracted from past excitation signal for said second delay candidate and quantization candidate, for all of the combinations between each of second delay candidates and each of quantization candidates, if the mode decision information outputted from said mode decision unit represents a predetermined mode.

17. The apparatus according to claim 1, further comprising:

an impulse response calculator for receiving the quantized spectral parameters and for calculating and outputting an impulse response of a weighting filter based on the quantized spectral parameters;

a weighting signal calculator for weighting the quantized gain output by said gain quantizer and for outputting a weighted signal as a result thereof;

a response signal quantizer for receiving the quantization candidates from said spectral parameter calculator for each of a plurality of subframes, and for calculating and outputting, using a stored value of a filter memory, a response signal for one subframe;

an audio weighting circuit for receiving the inputted speech signal divided into subframes and for receiving the plurality of quantization candidates from said spectral parameter calculator, for calculating an audio weighting on the speech signal in each of the subframes, and for outputting an audio-weighted speech signal as a result thereof; and a subtractor for subtracting the audio-weighted speech signal from the response signal to produce a subtracted signal as a result;

wherein said adaptive code book comprises:

a delay searching and distortion calculating circuit which receives the past excitation signal on a first input terminal, the subtracted signal on a second input terminal, and the impulse response on a third input terminal, and for determining the delay as a result;

a decision circuit for receiving a plurality of distortions and corresponding delays from the delay searching and distortion calculating circuit, and for determining the delay which provides the minimum distortion between the speech signal and said pitch predictive signal; and a residual calculator connected to receive the delay which provides the minimum distortion from said decision circuit and for effecting pitch prediction to determine a corresponding pitch predictive signal that is output to said excitation quantizer.

18. The apparatus according to claim 2, further comprising:

an impulse response calculator for receiving the quantized spectral parameters and for calculating and outputting an impulse response of a weighting filter based on the quantized spectral parameters;

a weighting signal calculator for weighting the quantized gain output by said gain quantizer and for outputting a weighted signal as a result thereof;

a response signal quantizer for receiving the quantization candidates from said spectral parameter calculator for each of a plurality of subframes, and for calculating and outputting, using a stored value of a filter memory, a response signal for one subframe;

an audio weighting circuit for receiving the inputted speech signal divided into subframes and for receiving the plurality of quantization candidates from said spectral parameter calculator, for calculating an audio weighting on the speech signal in each of the subframes, and for outputting an audio-weighted speech signal as a result thereof; and a subtractor for subtracting the audio-weighted speech signal from the response signal to produce a subtracted signal as a result;

wherein said adaptive code book comprises:

a search range setting circuit for presetting a search range for a plurality of delay and for outputting the predetermined delay range as a result;

a delay searching and distortion calculating circuit which receives the past excitation signal on a first input terminal, the subtracted signal on a second input terminal, and the impulse response on a third input terminal, and the predetermined delay range on a fourth input terminal, and for determining the delay as a result;

a decision circuit for receiving a plurality of distortions and corresponding delays from the delay searching and distortion calculating circuit, and for determining the delay which provides the minimum distortion between the speech signal and said pitch predictive signal; and a residual calculator connected to receive the delay which provides the minimum distortion from said decision circuit and for effecting pitch prediction to determine and output a corresponding pitch predictive signal for the delay which provides the minimum distortion.

19. The apparatus according to claim 3, further comprising:

an impulse response calculator for receiving the quantized spectral parameters and for calculating and outputting an impulse response of a weighting filter based on the quantized spectral parameters;

a weighting signal calculator for weighting the quantized gain output by said gain quantizer and for outputting a weighted signal as a result thereof;

a response signal quantizer for receiving the quantization candidates from said spectral parameter calculator for each of a plurality of subframes, and for calculating and outputting, using a stored value of a filter memory, a response signal for one subframe;

an audio weighting circuit for receiving the inputted speech signal divided into subframes and for receiving the plurality of quantization candidates from said spectral parameter calculator, for calculating an audio weighting on the speech signal in each of the subframes, and for outputting an audio-weighted speech signal as a result thereof; and a subtractor for subtracting the audio-weighted speech signal from the response signal to produce a subtracted signal as a result;

wherein said adaptive code book comprises:

a search range setting circuit for receiving the first delays and for determining and outputting a search range based on the second delay candidates neighboring said first delay;

a delay searching and distortion calculating circuit which receives the past excitation signal on a first input terminal, the subtracted signal on a second input terminal, and the impulse response on a third input terminal, and the search range on a fourth input terminal, and for determining the delay as a result;

a decision circuit for receiving a plurality of distortions and corresponding delays from the delay searching and distortion calculating circuit, and for determining the delay which provides the minimum distortion between the speech signal and said pitch predictive signal; and a residual calculator connected to receive the delay which provides the minimum distortion from said decision circuit and for effecting pitch prediction to determine a corresponding pitch predictive signal that is output to said excitation quantizer.

* * * * *